US006907625B2

(12) United States Patent
Nomura

(10) Patent No.: US 6,907,625 B2
(45) Date of Patent: Jun. 21, 2005

(54) SLIDING BED

(76) Inventor: Kyozo Nomura, 19-5, Syakujii-machi 4-chome, Nerima-ku, Tokyo, 177-0041 (JP)

( * ) Notice: Subject to any disclaimer, the term of this patent is extended or adjusted under 35 U.S.C. 154(b) by 0 days.

(21) Appl. No.: 10/439,848

(22) Filed: May 16, 2003

(65) Prior Publication Data

US 2004/0226093 A1 Nov. 18, 2004

(51) Int. Cl.[7] ..... A61G 7/08
(52) U.S. Cl. ..... 5/81.1 HS; 5/617
(58) Field of Search ..... 5/617, 81.1 R, 5/81.1 HS

(56) References Cited

U.S. PATENT DOCUMENTS 1,404,207 A * 1/1922 Lenz ..... 5/617

FOREIGN PATENT DOCUMENTS

| | | |
|---|---|---|
| JP | 3038378 | 4/1997 |
| JP | 2000-42053 | 2/2000 |

* cited by examiner

*Primary Examiner*—Michael Safavi
(74) *Attorney, Agent, or Firm*—Jordan and Hamburg LLP

(57) ABSTRACT

To devise a slide mechanism and to provide a sliding bed that is configured to be easy to slide and the height of which is freely adjustable, so as to lessen the burden on a caregiver, a sliding bed includes a bed base 1, a fixed bed frame 2 provided on the bed base 1, a movable bed frame 3 capable of moving in the widthwise direction of the bed base, and a seat and back rest on the movable bed frame 2, the back rest being capable of being raised either electrically or manually; the movable bed frame 3 is supported so as to capable of moving in the widthwise direction of the bed base 1 by at least two slide parts 4 provided on each of the two sides of the movable bed frame 3.

8 Claims, 10 Drawing Sheets

SLIDING BED

BACKGROUND OF THE INVENTION

1. Field of the Invention

The present invention relates to a sliding bed used in the care or nursing of the elderly or disabled (hereinafter, "patient") and designed so as to lessen the burden of a patient in a hospital or the like when getting into or out of a bed, or to lessen the burden of a caregiver for such patient.

2. Description of the Related Art

In conventional nursing beds for the disabled, the predominant art involves the raising up of the upper body of a patient. With just this art, however, a patient cannot get up by himself, nor can he lower his feet from the bed and assume a position as of sitting in a chair. Therefore, this is disadvantageous when considered from the perspective of patient treatment or rehabilitation, as the circulation of the bodily fluids throughout the entire body and the use of muscles throughout the body are far lower than for a healthy person; in addition, being unable to assume a state similar to sitting in a chair is disadvantageous when considered from the point of view of relieving stress and improving the psychological state of a patient.

For this reason, art has been proposed to allow a seat and back rest portion to move laterally, as can be seen in Japanese Utility Model Registration #3038378 or Japanese Laid-open Patent Application 2000-042053. Moving the seat or back rest portion laterally allows a patient to lower his feet from a bed, giving the patient the feeling of sitting in a bed.

In the sliding beds described in Japanese Utility Model Registration #3038378 and Japanese Laid-open Patent Application 2000-042053, the load on the sliding portion of the bed is supported by leg members, preventing the bed from tipping over during sliding.

However, when considered from the perspective of patient care, treatment, and safety, it is preferable that the height of the bed be such that the bed is positioned as close to the floor as possible when the patient is sleeping. For the person providing care, it is preferable that the bed height be raised, to a height that allows a caregiver to give care more efficiently. For this reason, in recent years, it has become standard for nursing beds or beds for the disabled to be configured to allow bed height to be changed.

In addition, when moving a patient on a sliding bed into a wheelchair or onto a portable toilet, having the height of the patient's waist when on the bed higher than the height of the wheelchair and the like results in improved efficiency in care-giving work, as a caregiver can take advantage of the difference in heights when moving the patient. Thus it is preferable that the height of a sliding bed be adjustable.

Further, because individual patients will have different body sizes, with the lengths of patients' legs in particular varying from individual to individual, it is difficult to adjust bed height to match individual patients.

Further, as in the art disclosed in Japanese Utility Model Registration #3038378 and Japanese Laid-open Patent Application 2000-042053, in cases of a configuration where a sliding portion is not supported by leg members, but support members are provided extending directly from the frame of the bed main body, the load on the sliding portion is centered on the bed end part on the slide side of the movement mechanism, and when a patient is placed thereupon, it is heavy and difficult to move. In addition, a bed used by patients needs to be disinfected or otherwise sterilized periodically, and a metal slide mechanism used in a slide bed can easily suffer from rusting or other such corrosion. In addition, it is necessary to bear in mind that, including the weight of the patient, a load of 100 kg or greater will bear upon the slide mechanism.

SUMMARY OF THE INVENTION

It is an object of the present invention to devise a slide mechanism, and provide a sliding bed that reduces the burden on a caregiver, by employing a configuration that allows for easy sliding and, further, that allows the height of the bed itself to be easily adjusted.

In order to solve the above-described problems, the present invention, in the aspect described in claim 1, is a sliding bed that includes a bed base, a fixed frame provided on the upper part of the bed base, a movable bed frame provided on the upper part of the bed base and capable of moving in the widthwise direction of the bed base, and a seat and back rest on the movable bed frame; the back rest can be raised up either electrically or manually. The movable bed frame is supported so as to be capable of moving in the widthwise direction of the bed base, by means of at least two or more slide parts provided on both sides, respectively, of the movable frame; thus a configuration is preferable such that the two slide parts include an intermediate slide frame and an upper slide frame that is provided on a side surface of the movable bed frame, and that the intermediate slide frame can slide with respect to the bed base, and the upper slide frame can slide with respect to the intermediate slide frame, by means of support members such as rollers.

Further, it is preferable to provide a tipping-over prevention member on the side of the bed base to which the movable bed frame is to be slidingly moved, in order to prevent the bed from tipping over, and to provide a balance weight on the side of the bed base opposite the side to which the movable bed frame is to be slid, or, alternatively, to provide a balance weight that in concert with the sliding movement of the movable bed frame moves to the opposite side, thereby providing stability to the sliding bed.

Further, the above-described sliding bed is provided with mats on the upper surfaces of the fixed bed frame and movable bed frame such that the upper surfaces thereof are aligned; of the end surfaces of the mats on the fixed bed frame and movable bed frame that come in contact with each other, one or both are formed to have a downward cutaway with a tapered or curved shape, and a shield is provided below the cutaway shape on either the fixed bed frame or movable bed frame.

DESCRIPTION OF THE PREFERRED EMBODIMENT

Figure 1A:
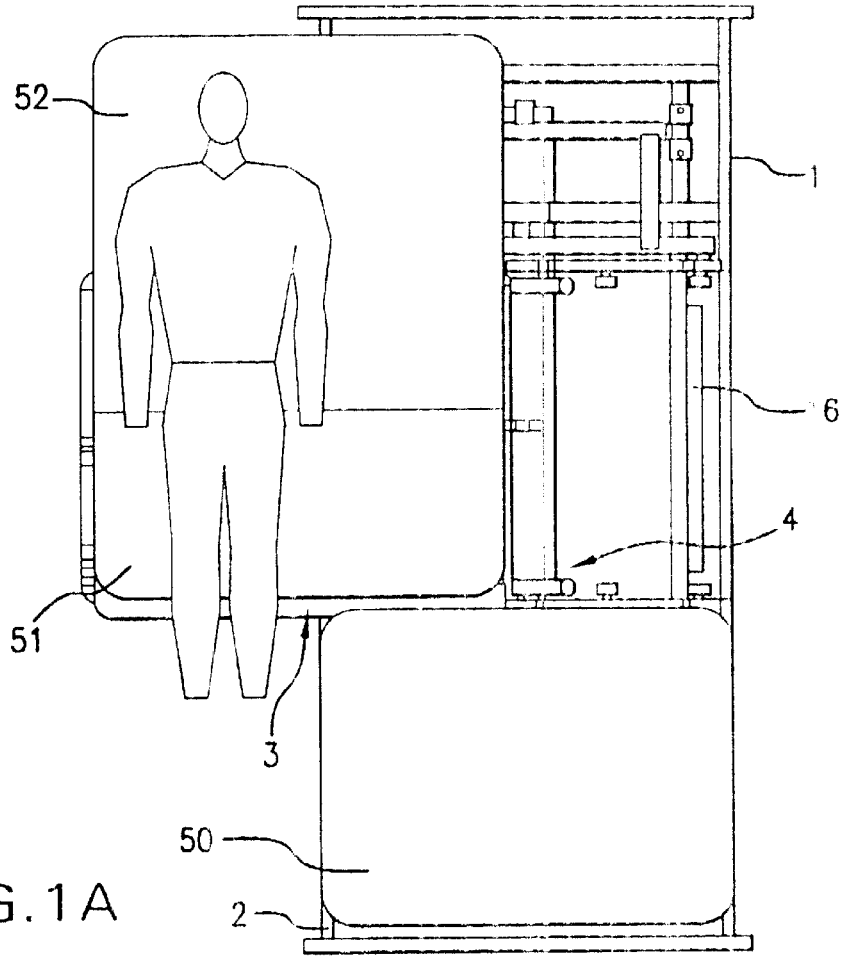
FIG. 1A is a drawing for explaining a sliding bed in accordance with the present invention.
Figure 1B:
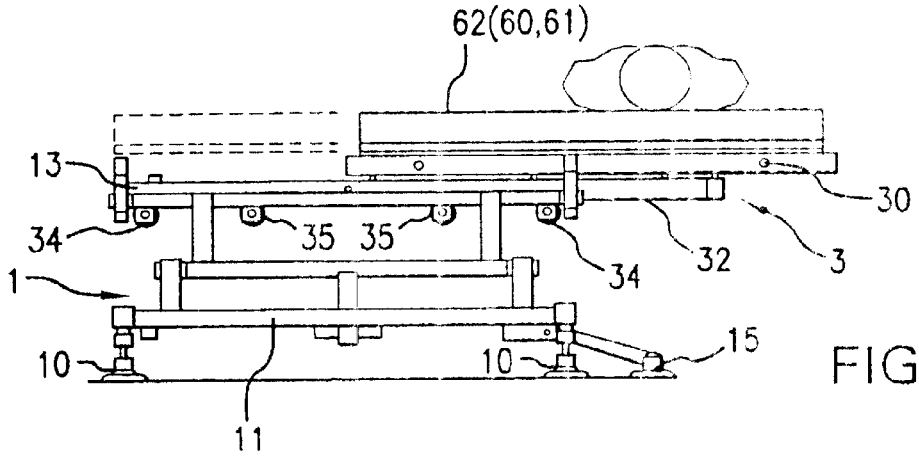
FIG. 1B is a top view of FIG. 1A.
Figure 2:
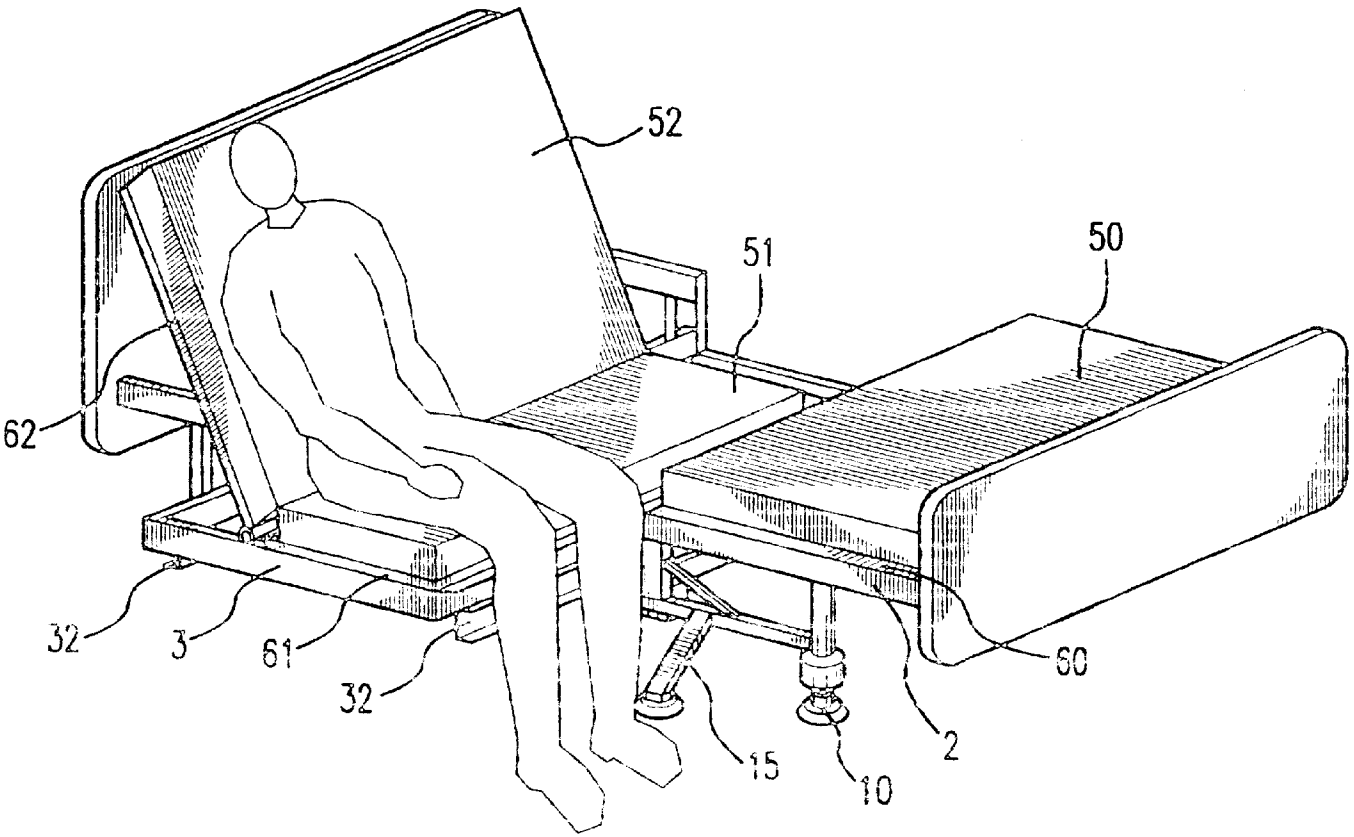
FIG. 2 is an oblique view showing the present invention in a state of use.

An explanation will now be given of the preferred embodiment of the present invention, using the accompanying drawings; however, the present invention should not be construed as being limited to such embodiment.

FIGS. 1A–6E show a first embodiment of the present invention.

Broadly speaking, the present invention comprises a bed base 1, a fixed bed frame 2 provided on the upper part of the bed base 1, a movable bed frame 3 capable of moving to a widthwise side of the bed base 1, a slide part 4 for moving the movable bed frame 3 to a widthwise side of the bed base 1, and a mat 5 mounted on the upper part of the bed.

These components will be discussed in order.

The Bed Base 1 and the Fixed Bed Frame 2

For the bed base 1, a strong material such as steel is used in a configuration that is substantially the same as what is typically used for this type of bed.

Figure 4A:
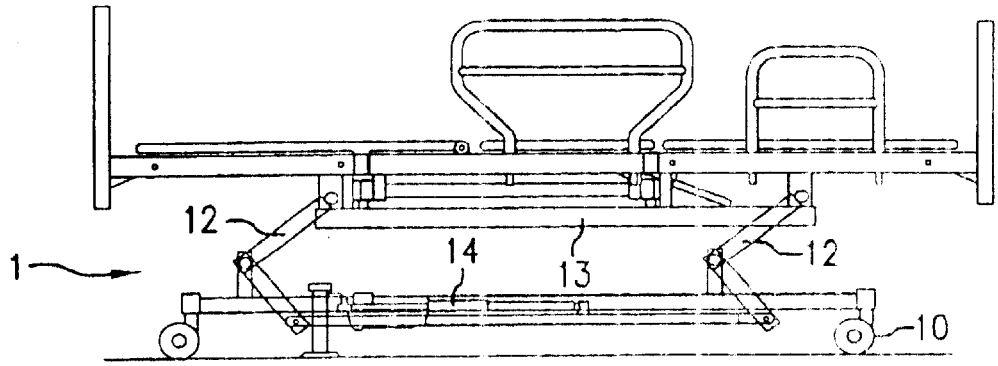
FIG. 4A is a drawing showing a bed in an elevated state.
Figure 4B:
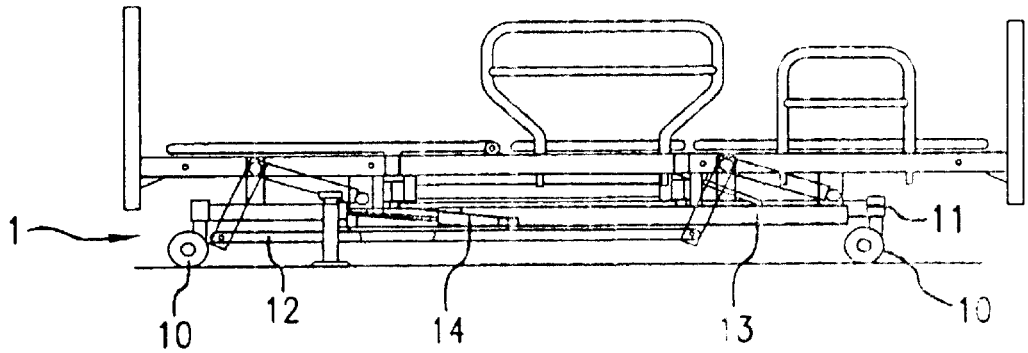
FIG. 4B is a drawing showing the bed in FIG. 4A in a lowered state.

For example, the bed base 1 can comprise a base frame 11 and an upper frame 13. The base frame 11 is supported by four bed legs 10, and the upper frame 13 is provided on the base frame 11 with a link mechanism 12 therebetween. Changes in the height of the upper frame 13 are effected by, for example, expansion and contraction (actuation) of an electric piston and cylinder 14, as shown in FIGS. 4A and 4B.

The upper frame 13 is configured so that near the center of the bed a space 130 is provided in which a movable bed frame 3 (discussed below) can slide. The portion above the legs is used as the fixed bed frame 2. Slide parts 4 (discussed below), which can be rollers or the like, are provided on portions facing this space.

Further, a tipping-over prevention member 15 is provided on the side of the base frame 11 to which the movable bed frame 3 slides and which is used as a chair. As shown in the figures, this tipping-over prevention member 15 may, for example, be configured so that the bottom surface thereof is disc-shaped and the height of the upper portion thereof is adjusted using a screw; alternatively, standard casters may be used.

Further, a balance weight 16 is provided on the side opposite the above-described tipping-over prevention member 15, that is, on the side of the base frame 11 opposite the side to which sliding is made, such balance weight having a weight that is about 20% of the weight of the patient using the bed, for example, a weight of 20 kg for a patient weighing 100 kg.

In cases where the bed base 1 can be fixed in a room or where a bed will not be moved, if the environment is such that the sliding out side and the opposite side can be anchored or otherwise fixed to the floor, it goes without saying that the above-described weight balance 16 does not have to be used.

Further, as is described below, the frame on the side on which a patient's upper body will rest is supported by the movable bed frame 3. For this reason, the portion of the upper frame 13 on the upper body side is configured so that no particular support is carried out.

The Movable Bed Frame 3 and Slide Parts 4

Figure 3:
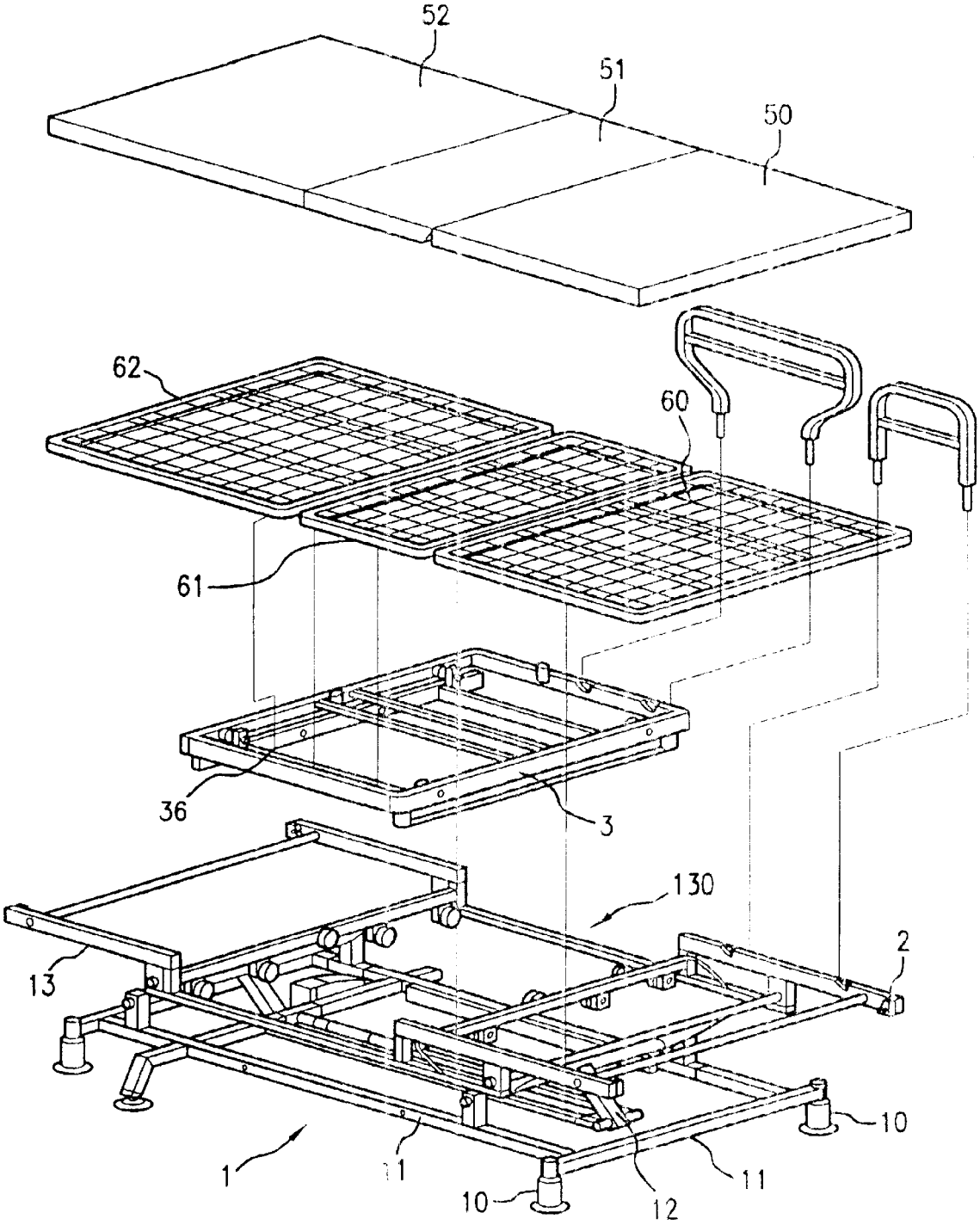
FIG. 3 is an exploded oblique view of a sliding bed according to the present invention.
Figure 5A:
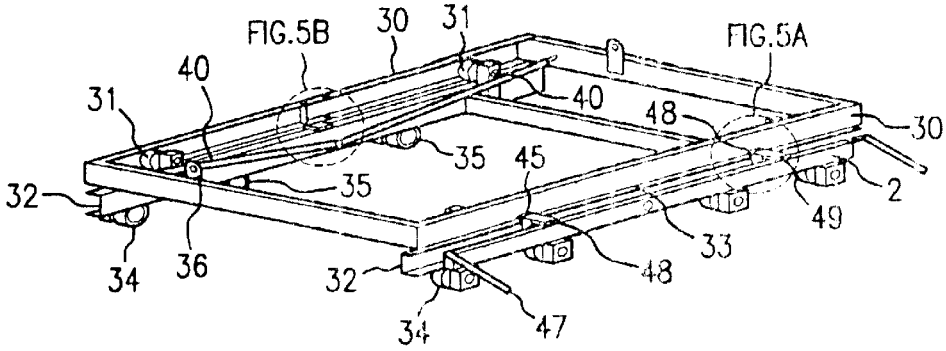
FIG. 5A is an oblique view for explaining a slide part used in the present invention.
Figure 5B:
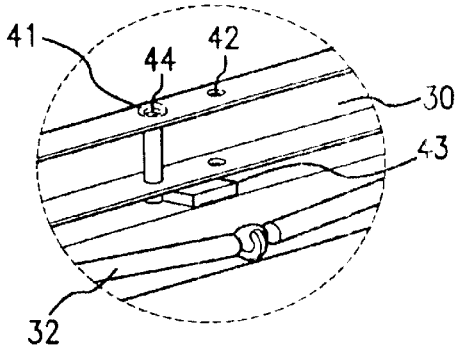
FIGS. 5B and 5C are enlargements of portions of FIG. 5A.
Figure 5C:
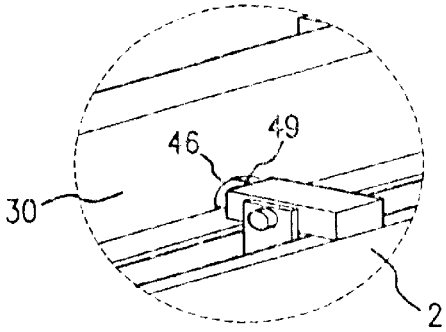
Figure 5D:
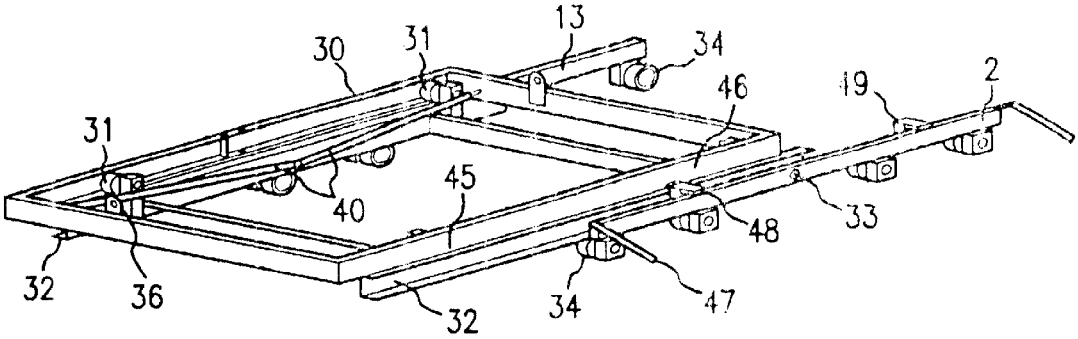
FIG. 5D shows the device in FIG. 5A in a slid-out state.

As shown in FIGS. 3, 5A, and 5D, the movable bed frame 3 slides to a side of the bed base 1, within the space 130 between the upper frame 13 and the fixed bed frame 2 by means of the slide parts 4.

The movable bed frame 3 is made from a relatively strong material such as steel; in this embodiment, it is formed as a rectangular frame. Levers on both sliding sides form channel-shaped upper slide frames 30. Upper slide frame support rollers 31, which are movable within these upper slide frames 30 and which have a width dimension that is slightly smaller than the internal width of the groove of the upper slide frames 30, are movably inserted therein.

These upper slide frame support rollers 31 are fixed to an intermediate slide frame 32, with consideration given to the amount of sliding from the movable bed frame 3.

For the intermediate slide frame 32, a channel shaped opening in a direction opposite to that of the upper slide frame 30 is used, and an intermediate slide frame support roller 33 is provided in the space within the intermediate slide frame 32. The location at which the intermediate slide frame support roller 33 is provided can be, for example, the widthwise center of the upper frame 13 and fixed bed frame 2.

Further, the bottom surface of the intermediate slide frame 32 is supported by intermediate slide frame mounting rollers 34 provided, respectively, on the upper frame 13 and fixed bed frame 2, on both ends of the space 130, in the movable bed frame 3 slide direction; the intermediate slide frame 32 is also supported by the intermediate slide frame support roller 33 in such as a manner as to be able to move back and forth along the upper frame 13 and the fixed bed frame 2.

In addition, because the space between the intermediate slide frame mounting roller 34 and the intermediate slide frame support roller 33 is large, in this embodiment, guide rollers 35 are provided; when the slide parts move, these serve to facilitate the transfer to the intermediate slide frame mounting roller 34.

In the above-described embodiment, because a large load bears upon the intermediate slide frame mounting roller 34 during sliding and therefore there is a slight downward positional shift, the intermediate slide frame 32 will bend upwards centered on the intermediate slide frame mounting roller 34. For this reason, when one tries to pull the intermediate slide frame back, the transfer to the guide roller 35 and intermediate slide frame mounting roller 34 may not occur smoothly. To address this, the intermediate slide frame mounting roller 34 is positioned from 0.5 to 1.0 mm higher, with the precise degree depending on the thickness of the material used for the intermediate slide frame 32.

Further, the upper and intermediate slide frames are disposed vertically with respect to each other and the directions of their openings are opposite to each other; however, the present invention is not limited to such a configuration. That is to say, provided that the movable bed frame can support the load thereupon using at least two slide frames, configurations other than that described above can be used.

FIGS. 5A and 5D show oblique views of the slide part 4, with FIG. 5A showing a contained state and FIG. 5D showing a slid-out state. The center of the intermediate slide frame 32 and both ends of the upper slide frame 30 are connected in the sliding direction by a spring 40. Further, in two places, to the left and right of and near the center of the upper slide frame 30 are formed pinholes 41, 42; a pin receiving/positioning pin stop block 43 is provided in the center of the intermediate slide frame 32. By inserting a left/right intermediate slide frame positioning pin 44 into a left/right intermediate slide frame pin hole 41 on the side to which sliding is made, movement of the upper slide frame 30 along the intermediate slide frame 32 in the pushing direction can be controlled.

An explanation will be made of the lock mechanism that maintains the upper slide frame 30 in the slid state, using FIGS. 5A–5D. As a specific lock mechanism, for example, two lock grooves 45, 46 are provided on the upper slide frame 30. Lock block wheels 48, 49 provided on a lock removal lever 47 provided on the upper frame 13 (or on the fixed bed frame 2) can be inserted into these lock block grooves 45, 46; therefore, for example, the lock block grooves 45, 46 are formed to have the same radius as the lock block wheels and a depth of 2 mm. With regard to the positions at which the lock block grooves 45, 46 and the lock block wheels 48, 49 are provided, when the bed is used before sliding, the lock block wheels 48, 49 are inserted respectively into the two lock block grooves 45, 46; when the movable bed frame 3 has been slid and is at the position for use as a chair, the foremost lock block wheel 48 is inserted into the deeper lock block groove 46; so doing fixes the movable bed frame 3 at the upper frame 13 (or at the fixed bed frame 2).

When the upper slide frame 30 is moved, the lock block wheels 48, 49 roll along the bottom surface or bottom surface corner of the upper slide frame 30.

Next, an explanation will be given of a load support state in a case where the above-described two slide frames are used and in a case where the load is supported simply.

FIGS. 6A–6E show a configuration in which the movable bed frame 3 is simply supported directly on the upper frame 13 by four support rollers (a), (b), (c), and (d). FIGS. 7A–7E show a configuration in which the upper slide frame 30 and intermediate slide frame 32 according to the present invention are supported with two upper slide frame support rollers (e), (f), intermediate slide frame mounting rollers (g), (k), intermediate slide frame support roller (i), and guide rollers (h, j) interposed therebetween.

As shown in the configurations of FIGS. 6A–6E and 7A–7E, the movable bed frame 3 is moved at slide strokes of 0 mm, 120 mm, 240 mm, 360 mm and 480 mm; Table 1 shows the load on each support roller in cases where an intermediate slide frame is not used and a load of 100 kg is applied in the direction indicated by the arrows, and Table 2 shows the load on each support roller when an intermediate support roller is used.

As two slide parts are used, the figures in the table show the load on one slide part.

TABLE 1

| Slide amount | Support roller (a) | Support roller (b) | Support roller (c) | Support roller (d) |
|---|---|---|---|---|
| (a) 0 mm | 33 kg | 17 kg | 0 kg | 0 kg |
| (b) 120 mm | 51 kg | 0 kg | −1 kg | 0 kg |
| (c) 240 mm | 58 kg | 0 kg | −18 kg | 0 kg |
| (d) 360 mm | 78 kg | 0 kg | −28 kg | 0 kg |
| (e) 480 mm | 106 kg | −56 kg | 0 kg | 0 kg |

TABLE 2

| Slide amount | Support roller (e) | Support roller (f) | Support roller (g) | Support roller (h) | Support roller (i) | Support roller (j) | Support roller (k) |
|---|---|---|---|---|---|---|---|
| (a) 0 mm | 48 kg | 2 kg | 34 kg | 0 kg | 16 kg | 0 kg | 2 kg |
| (b) 120 mm | 48 kg | 2 kg | 51 kg | 0 kg | −1 kg | 0 kg | 0 kg |
| (c) 240 mm | 48 kg | 2 kg | 67 kg | 0 kg | −17 kg | 0 kg | 0 kg |
| (d) 360 mm | 48 kg | 2 kg | 82 kg | 0 kg | −32 kg | 0 kg | 0 kg |
| (e) 480 mm | 58 kg | −8 kg | 98 kg | 0 kg | −48 kg | 0 kg | 0 kg |

As can be seen from these tables, in either case, when pulling out commences, the center of gravity is toward the inside of the bed, meaning that sliding can be accomplished relatively easily. In the states shown in FIGS. 6C–6E and 7C–7E, an upwards load bears upon rollers (c) and (i). This becomes somewhat heavy. However, because the movable bed frame 3 is in a state of movement in FIGS. 6A, 6B, 7A, and 7B, it is relatively easy to move the movable bed frame 3.

Figure 6A:
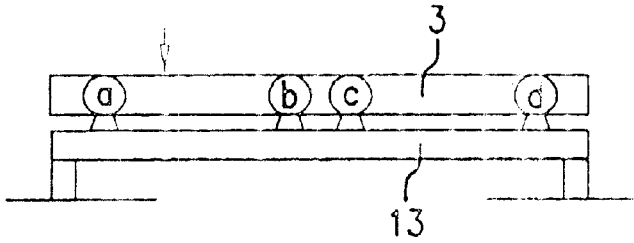
FIGS. 6A–6E are drawings showing a load condition when a movable bed frame of a conventional bed is supported in a manner so as to be slidingly movable on an upper frame and showing different positions of the movable bed frame.
Figure 6B:
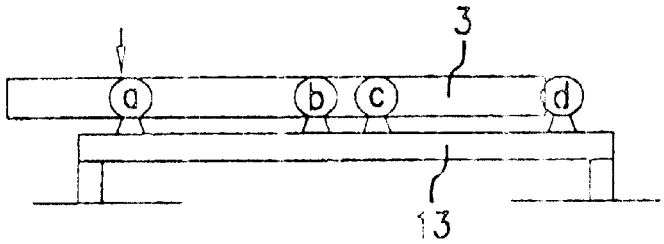
Figure 6C:
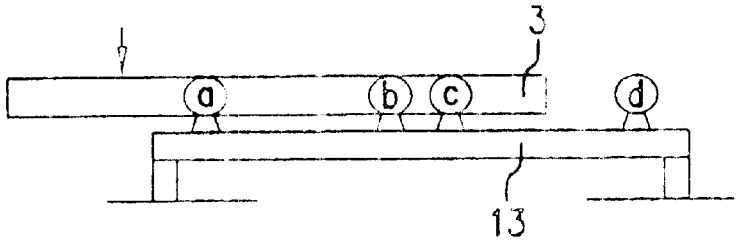
Figure 6D:
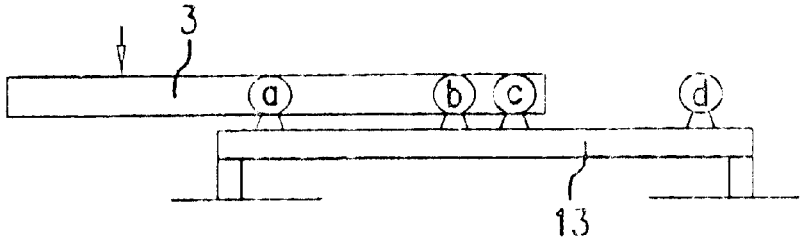
Figure 6E:
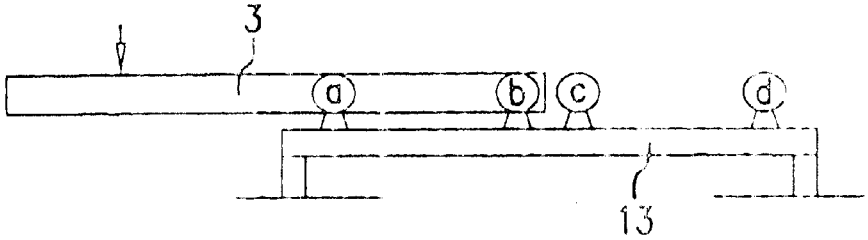
Figure 7A:
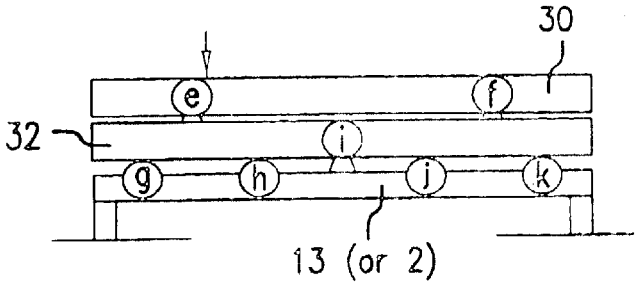
FIGS. 7A–7E are drawings showing a load condition when a movable bed frame of a bed according to the present invention is supported in a manner so as to be slidingly movable on an upper frame and showing different positions of the movable bed frame.
Figure 7B:
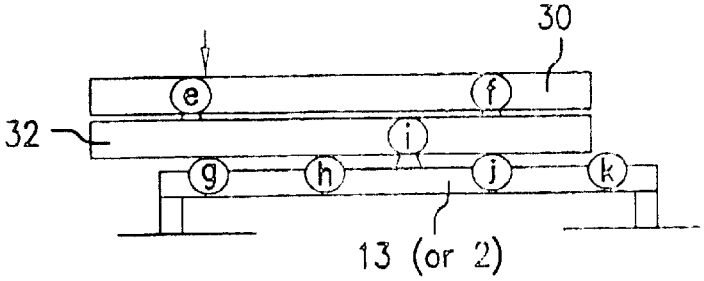
Figure 7C:
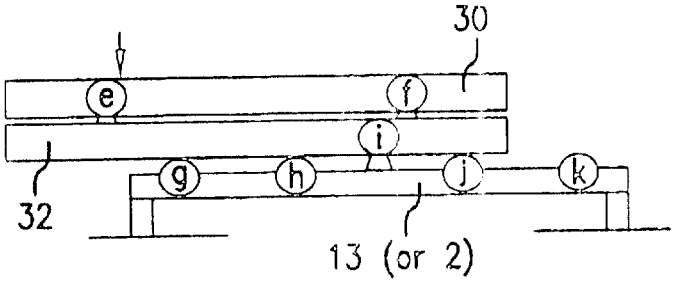
Figure 7D:
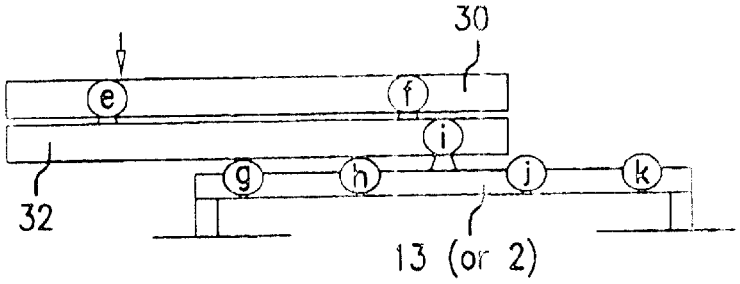
Figure 7E:
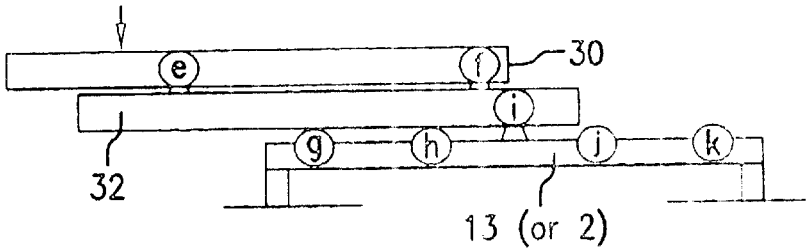

An explanation will now be given of returning from a state in which the movable bed frame 3 has been slid out (FIGS. 6E and 7E) to a state in which the bed is used as a standard bed (FIGS. 6A and 7A).

In cases where an intermediate slide frame is not used, because the load bears on the support roller (a) at the end of the upper frame 13 and the support roller at the far end of the movable bed frame 3, when the movable bed frame 3 is pulled out to the farthest extent, a load of 106 kg bears upon the support roller (a) and an upwards load of 56 kg bears upon the support roller (b). For this reason, when one attempts to slide the movable bed frame 3 to a standard state, it becomes extremely heavy.

In contrast, in cases where the intermediate slide frame 32 is used, as shown in the tables, the load that bears upon the roller (e), which is the outermost roller on the slide side of the upper slide frame 30, is 48 kg. In addition, a load of 98 kg bears upon the roller (g) on the end of the upper frame 13. Also, with regards to the portion of the support roller (i) provided in the center of the upper frame 13, which is in the same positional relationship as the roller (b) when the intermediate slide frame 31 is not used, the upwards load when the movable bed frame 3 is pulled out to the farthest extent is 48 kg. In such a state, if one wishes to slide the upper slide frame 30 to a standard state, because an upwards load of 48 kg bears upon the roller (i), the intermediate slide frame 31 is heavy when sliding is attempted. However, the upper slide frame 30 can be easily moved with just light force, as a load of 58 kg bears upon the roller (e) and an upwards load of 8 kg—which, while in the opposite direction, is not a particularly large force—bears upon the roller (f). Movement to the state shown in FIG. 7C can be easily accomplished. Thereafter, through continuous operation, sliding is possible; further, because in the position shown in FIG. 7D, in which the upper slide frame 30 and intermediate slide frame 31 are at substantially the same position, the load on the support roller (i) is an upwards load of 32 kg, meaning that pulling back can be accomplished with no practical difficulties.

Mat 5

An explanation will now be given for the mat 5 mounted on the slide bed upper surface.

The mat 5 is divided into a leg mat 50, a waist mat 51 and an upper body mat 52.

The upper body mat 52 can be raised up and is formed so as to be connected with the waist mat 51 with an appropriate means such as a cover, so that when the upper body mat 52 is in a down position there is no gap between it and the waist mat 51.

The leg mat 50, waist mat 51, and upper body mat 52 are configured so as to be mounted upon the mat mounting bodies 60, 61 and 62, respectively; the waist mat 50 and the mat mounting body 60 are mounted on the fixed bed frame 2 and fixed thereto with appropriate means. Further, the waist mat 51 and the mat mounting body 61 are mounted upon the movable bed frame 3 and fixed thereto with appropriate means. Further, the upper body mat 52 and the mat mounting body 62 are mounted on the movable bed frame 3 on the side opposite the leg mat 50, with the waist mat 51 interposed therebetween, and the end of the mat mounting body 62 on the waist mat 51 side is pivotably supported by a pivot support 36 provided on the movable bed frame 3, and the bottom surface of the mat mounting body 62 is supported by the movable bed frame 3. Then, by electric or manual means not shown in the figures, the end of the mat mounting body 62 can be raised up with the pivot support 36 as the rotation shaft.

Therefore, the waist mat 51 and the upper body mat 52 move unitarily with the movable bed frame 3.

The shape of the ends of the mat 5 will be discussed.

On the end surfaces of the leg mat 50 and waist mat 51 that come in contact with each other, the lower sides of the mat ends are formed to have a cutaway shape.

Figure 8A:
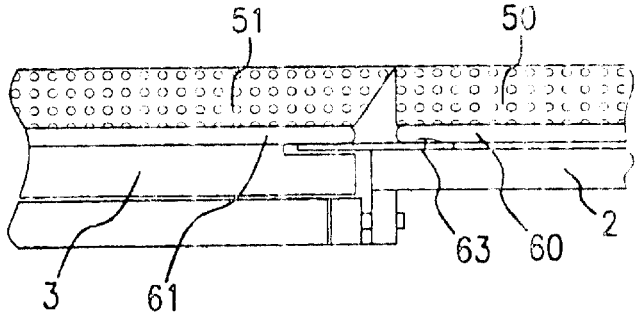
FIGS. 8A–8D are drawings for explaining a mat used in the present invention and showing different shapes of the mat ends.
Figure 8B:
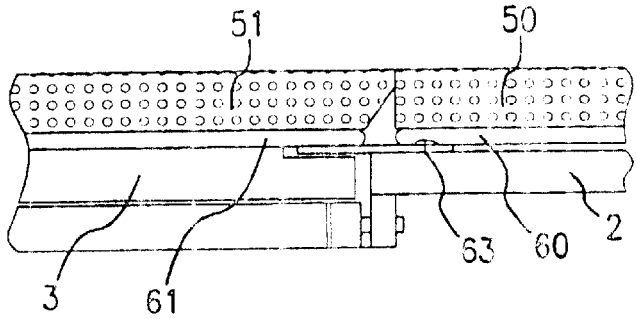
Figure 8C:
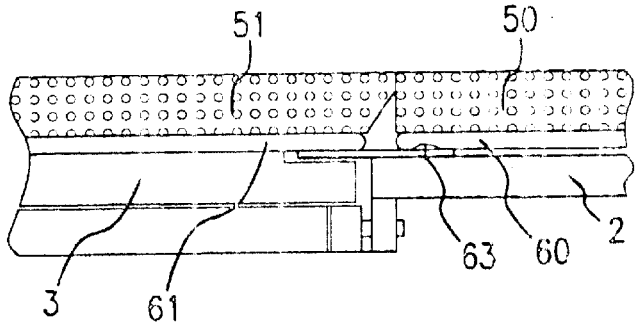

The cutaway shape can be a tapered shape (e.g., FIGS. 8A and 8B) or it can be a curved shape (FIG. 8C). The position at which the cutaway shape is provided is the lower side of the mat; as shown in FIG. 8A, this can start virtually at the top edge; however, it is preferable to have this start at a position that is one-third of the mat thickness from the top. The cutaway shape may be provided on one or both of the leg mat 50 and waist mat 51.

The reason for providing cutaway shapes in such a manner is, when the bed is made to slide, the resistance of flexible mats is large, and the force needed for causing sliding becomes large.

Further, because the covers or sheets normally covering the leg mat 50 and waist mat 51 have but a small contact surface, there are only small portions that will suffer wear; in addition, the sheets are unlikely to get tangled, and can be placed on the mats easily.

Furthermore, an expanded polyurethane material with a relatively low specific gravity of 0.025 is generally used for the mat's upper surface side, and an expanded polyurethane material with a relatively high specific gravity of 0.07, is used for the bottom surface side. Therefore, by providing, as described above, a configuration such that the lower side of one or both sides of the mat end is cut away, the mat resistance can be lowered, meaning that pulling-out resistance can be lowered.

Figure 8D:
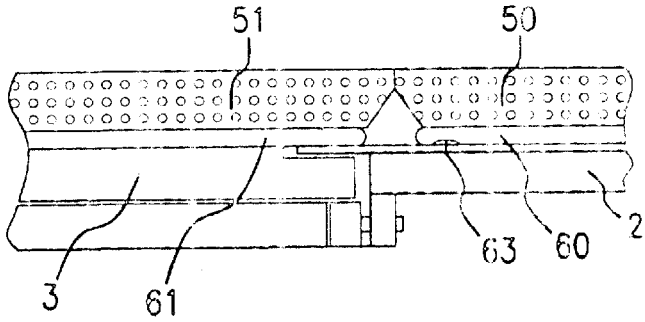
Figure 9:
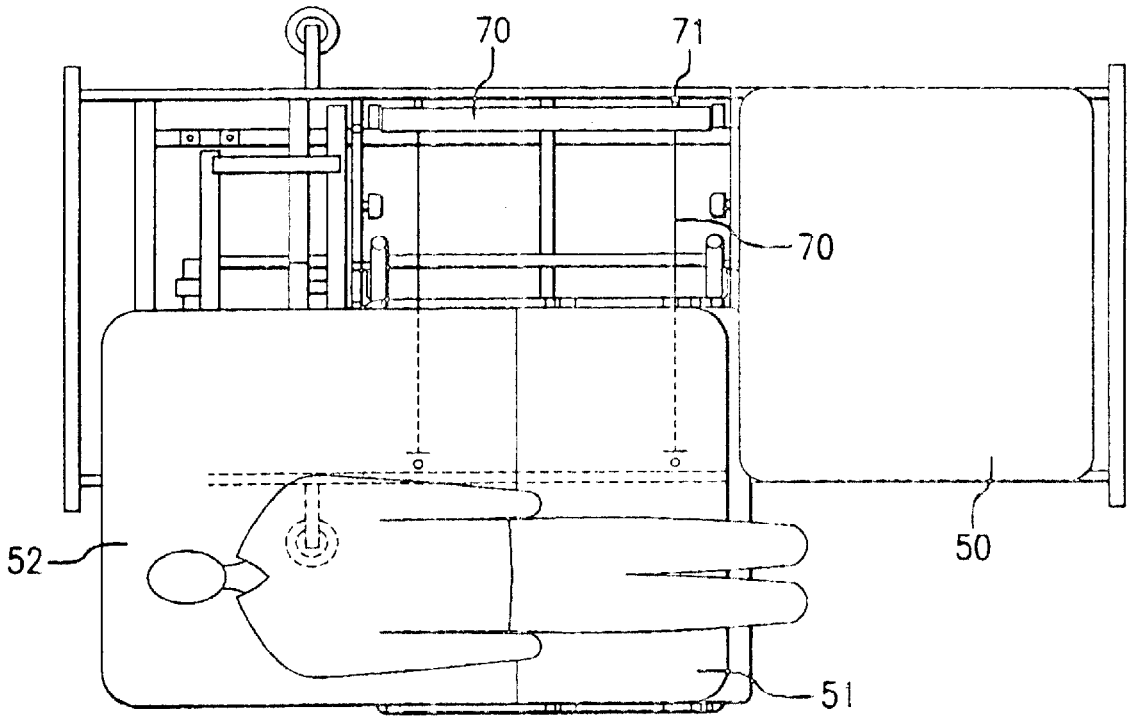
FIG. 9 is a plan view showing an embodiment of a slide bed according to the present invention in which a balance weight is caused to move.

Because a configuration in which the lower side of a mat end has a cutaway shape will allow a draft to pass through from the mat end, it is preferable to provide a shielding plate 63, as shown in FIG. 8D.

Other Embodiment

Next, in the embodiment shown in FIGS. 9 to 12, the balance weight 16 described above is not fixed to the bed, but moves in accordance with slide amount.

Thus the intermediate slide frame 32 and a moving balance weight 70 capable of moving along a moving guard rail are connected by a wire 72 that changes direction by means of a wire sheave 71 provided on the upper frame 13 (or fixed bed frame 2).

Figure 10:
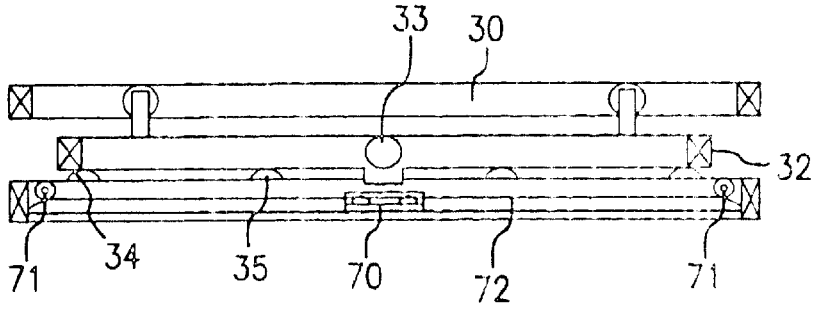
FIG. 10 is a drawing for explaining the embodiment shown in FIG. 9 prior to sliding.
Figure 11:
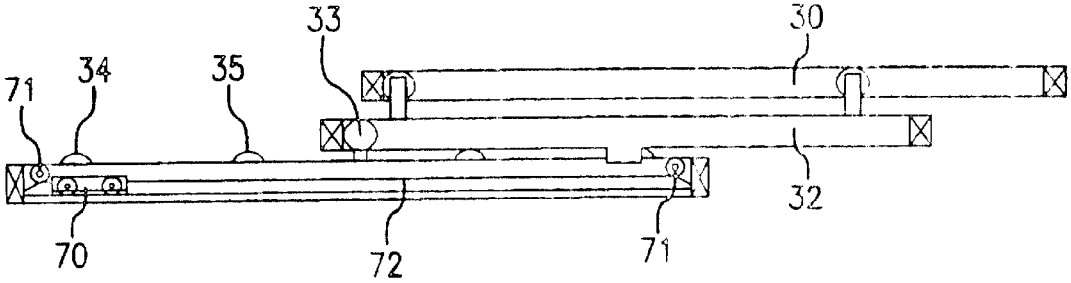
FIG. 11 is a drawing for explaining the embodiment shown in FIG. 9 subsequent to sliding.

Therefore, as shown in FIG. 11, when the upper slide frame 30 is moved from the state shown in FIG. 10 to the right side, the intermediate slide frame 32, in accordance with the sliding of the movable bed frame 3, moves in the opposite direction of the movable bed frame 3 slide direction, by means of the wire 72, operating to offset the movement of the center of gravity of the movable bed frame 3. Therefore, the movable bed frame 3 can be pulled in either direction, increasing the range of use of the sliding bed.

Figure 12:
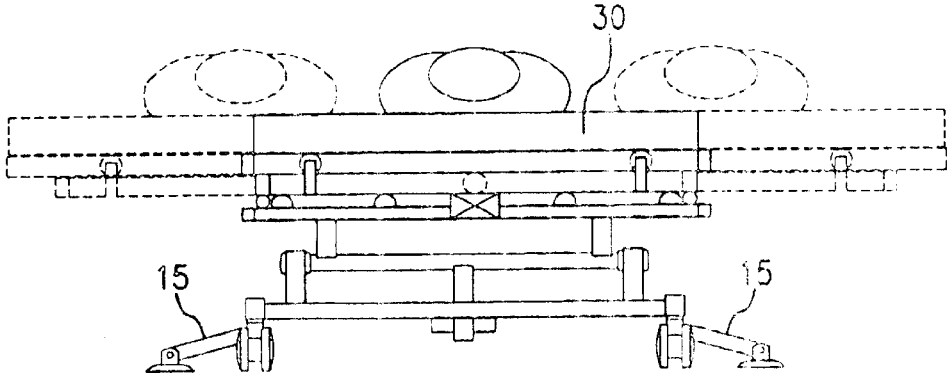
FIG. 12 is a lateral view of the embodiment shown in FIG. 9.

It should be noted that while the above-described moving weight balance 70 can be used to prevent tipping over, in order to provide greater protection against tipping over, it is preferable to provide tipping-over prevention members 15 on both directions of the bed base 1, as shown in FIG. 12.

Effect of the Invention

As described above, a sliding bed according to the present invention has a configuration in which both sides of a movable bed frame are caused to slide using two or more slide parts, thereby allowing movement to commence with that slide part having the least resistance to sliding. For this reason, during slide commencement, when much force is usually needed, movement can be effected using relatively small force.

A sliding bed according to the present invention is stable even when the height is adjusted, and the height can be freely adjusted; therefore, when a patient on a sliding bed is transferred to a wheelchair or portable toilet, the height of the sliding bed can be adjusted to be slightly higher than the wheelchair or portable toilet, and the patient can be transferred to the wheelchair or the like without being carried, by making use of this difference in height, resulting in far greater efficiency in care-giving tasks.

Further, because the tipping-over prevention member and slide parts are formed unitarily, height adjustment of the bed is easy. Further, by providing a tipping-over prevention member or a balance weight on the side of the bed base opposite the side to which sliding is made, the tipping over of a sliding bed can be more safely assured.

Further, by providing a moving balance weight that moves to the opposite side in concert with the sliding movement of the movable bed frame, the sliding bed can be slid in either direction, resulting in a significant expansion of uses for the bed.

Explanation of the Reference Numbers

1: BED BASE

10: BED LEG

12: LINK MECHANISM
13: UPPER FRAME
130: SPACE
14: ELECTRIC PISTON AND CYLINDER
15: TIPPING-OVER PREVENTION MEMBER
16: BALANCE WEIGHT
2: FIXED BED FRAME
3: MOVABLE BED FRAME
30: UPPER SLIDE FRAME
31: UPPER SLIDE FRAME SUPPORT ROLLER
32: INTERMEDIATE SLIDE FRAME
33: INTERMEDIATE SLIDE FRAME SUPPORT ROLLER
34: INTERMEDIATE SLIDE FRAME MOUNTING ROLLER
35: INTERMEDIATE SLIDE FRAME GUIDE ROLLER
36: PIVOT SUPPORT
4: SLIDE PART
40: SPRING
41, 42: PINHOLE
43: PIN RECEIVING/POSITIONING PIN STOP BLOCK
44: PIN
45, 46: LOCK GROOVE
47: LOCK REMOVAL LEVER
48, 49: LOCK BLOCK WHEEL
5: MAT
50: LEG MAT
51: WAIST MAT
52: UPPER BODY MAT
60, 61, 62: MAT MOUNTING BODY
63: SHIELDING PLATE
70: MOVING BALANCE WEIGHT
71: WIRE SHEAVE
72: WIRE

What is claimed is:

1. A sliding bed, comprising:

a bed base;

a fixed bed frame provided on an upper part of said bed base;

a movable bed frame provided on the upper part of said bed base and capable of moving to at least one of two widthwise direction sides of said bed base;

a seat and a back rest on said movable bed frame, said back rest being capable of being raised electrically or manually; and support means for said movable bed frame, said support means comprising at least two slide parts provided on each of the two sides of the movable bed frame, said at least two slide parts being slidably movable relative to one another and to said fixed bed frame, said movable bed frame being supported by said support means so as to be capable of moving in the bed base widthwise direction by means of said slide parts.

2. A sliding bed according to claim 1, further comprising:

a tipping-over prevention support member for preventing tipping over to the floor on which the bed is placed provided on the side of the bed base to which the movable bed frame is slidingly moved.

3. A sliding bed according to claim 1, further comprising:

a balance weight provided on the bed base and that moves to the opposite of said sides in concert with sliding movement of tl-ie movable bed frame to one of said sides.

4. A sliding bed, comprising:

a bed base;

a fixed bed frame provided on an under part of said bed base;

a movable bed frame provided on the upper part of said bed base and capable of moving to at least one of two widthwise direction sides of said bed base;

a seat and a back rest on said movable bed frame, said back rest being capable of being raised electrically or manually;

support means for said movable bed frame, said support means comprising at least two slide parts provided on each of the two sides of the movable bed frame, said movable bed frame being supported by said support means so as to be capable of moving in the bed base widthwise direction by means of said slide parts;

an intermediate slide frame and an upper slide frame provided on a side surface of the movable bed frame, said slide frames comprising the slide parts; and support members further comprising the support means, the intermediate slide frame being slidable with respect to the bed base and the upper slide frame being slidable with respect to the intermediate slide frame by means of said support members.

5. A sliding bed according to claim 4, wherein the support members comprise rollers.

6. A sliding bed, comprising:

a bed base;

a fixed bed frame provided on an upper part of said bed base;

a movable bed frame provided on the upper part of said bed base and capable of moving to at least one of two widthwise direction sides of said bed base;

a seat and a back rest on said movable bed frame, said back rest being capable of being raised electrically or manually;

support means for said movable bed frame, said support means comprising at least two slide parts provided on each of the two sides of the movable bed frame, said movable bed frame being supported by said support means so as to be capable of moving in the bed base widthwise direction by means of said slide parts; and a balance weight provided on a side of the bed base opposite the side to which the movable bed frame is slidingly moved.

7. A sliding bed, comprising:

a bed base;

a fixed bed frame provided on an upper part of said bed base;

a movable bed frame provided on the upper part of said bed base and capable of moving to at least one of two widthwise direction sides of said bed base;

a seat and a back rest on said movable bed frame, said back rest being capable of being raised electrically or manually;

support means for said movable bed frame, said support means comprising at least two slide parts provided on each of the two sides of the movable bed frame, said movable bed frame being supported by said support means so as to be capable of moving in the bed base widthwise direction by means of said slide parts; and mats provided on upper surfaces of the fixed bed frame and movable bed frame in such manner that the upper surfaces thereof are aligned, and of the end surfaces of the mats on said fixed bed frame and movable bed frame that come in contact with each other, one or both are formed to have a downward cutaway with a tapered or curved shape.

8. A sliding bed according to claim 7, wherein a shielding body is provided below the cut-away shape on either the fixed bed frame or movable bed frame.

* * * * *